US007445185B1

(12) United States Patent
Cicero

(10) Patent No.: US 7,445,185 B1
(45) Date of Patent: Nov. 4, 2008

(54) MAGNETIC HEALTH CLUB ACCESSORY

(76) Inventor: Vincent P. Cicero, 14 Merritt La., Bayville, NY (US) 11709

( * ) Notice: Subject to any disclaimer, the term of this patent is extended or adjusted under 35 U.S.C. 154(b) by 0 days.

(21) Appl. No.: 11/739,913

(22) Filed: Apr. 25, 2007

(51) Int. Cl.
*A47K 1/08* (2006.01)

(52) U.S. Cl. ..... 248/312; 248/206.5; 248/304; 248/309.1; 211/16

(58) Field of Classification Search ..... 248/312, 248/206.5, 214, 215, 225.21, 301, 304, 311.2, 248/309.1, 108; 211/16, 71.01, 89.01, 88.04, 211/106.01, 75; 224/148.7, 197, 901, 932; 220/475, 23.8, 555, 625, 630, 729, 737, 771
See application file for complete search history.

(56) References Cited

U.S. PATENT DOCUMENTS

| | | | | | |
|---|---|---|---|---|---|
| 1,937,911 | A | * | 12/1933 | Pajeau | 211/116 |
| 3,023,991 | A | | 3/1962 | Fisher | |
| 3,149,268 | A | | 9/1964 | Hansen | |
| 3,329,277 | A | | 7/1967 | Gaudino | |
| 3,982,716 | A | | 9/1976 | Trees | |
| 4,015,810 | A | * | 4/1977 | Williams | 248/311.2 |
| 4,278,225 | A | * | 7/1981 | Phelps | 248/311.3 |
| 4,484,682 | A | | 11/1984 | Crow | |
| 4,660,715 | A | | 4/1987 | Anastos | |
| 4,736,853 | A | | 4/1988 | O'Mara | |
| 4,784,360 | A | * | 11/1988 | Mok | 248/313 |
| 4,957,260 | A | * | 9/1990 | Shelley | 248/311.3 |
| 5,409,190 | A | | 4/1995 | Mattox | |
| 5,423,509 | A | * | 6/1995 | LaPorte et al. | 248/311.2 |
| 5,603,418 | A | * | 2/1997 | Tellefsen | 211/113 |
| 5,992,807 | A | | 11/1999 | Tarulli | |
| 6,357,616 | B1 | * | 3/2002 | Harris et al. | 220/475 |
| 6,536,590 | B1 | * | 3/2003 | Godshaw et al. | 206/373 |
| 6,983,918 | B1 | * | 1/2006 | Leasure | 248/311.2 |
| 2006/0081749 | A1 | * | 4/2006 | Sherman et al. | 248/309.1 |
| 2007/0227991 | A1 | * | 10/2007 | Brustein et al. | 211/119.005 |

FOREIGN PATENT DOCUMENTS

| | | | |
|---|---|---|---|
| CA | 2 459 662 | A1 | 9/2004 |
| WO | WO 03/084805 | A1 | 10/2003 |
| WO | WO 2005/028317 | A2 | 3/2005 |
| WO | WO 2005/123537 | | 12/2005 |

* cited by examiner

*Primary Examiner*—Korie H. Chan
(74) *Attorney, Agent, or Firm*—Michael A. Blake

(57) ABSTRACT

A health club accessory comprising: a front semicylindrical wall, with a top surface; a rear wall attached to the front semicylindrical wall; a bottom wall attached to the front semicylindrical wall and rear wall, the front semicylindrical, rear wall, and bottom wall defining a semicylindrical volume; a handle member attached to the bottom wall, and extending out from semicylindrical front wall by a distance D, the handle member comprising: an underside; a downward extending handle, an upwardly extending guide 46 extending from the handle; a towel surface located on the handle member between the upwardly extending guide and the semicylindrical front wall; a semicylindrical groove located on the underside of the handle member; an elongated holding member extending downwardly from the rear wall two orthogonal members located at a distal end of the holding member, the two orthogonal members being generally at right angles to the elongated holding member, a space located between the two orthogonal members; a taper on the rear wall with an angle θ, which creates a fulcrum point on the rear wall; and a magnet located flush on the rear wall.

9 Claims, 3 Drawing Sheets

MAGNETIC HEALTH CLUB ACCESSORY

TECHNICAL FIELD

The present invention relates to a magnetic accessory for use in a health club, and more particularly pertains to a magnetic accessory for holding items such as a water bottle, cell phone, keys.

BACKGROUND

People who go to a health club or gym often wish to bring along personal items such as a towel, water bottle, cell phone, ipod, wallet, car keys, etc. Many health clubs and gyms disallow the carrying of gym bags on the health club floor due to a fear of theft, tripping, and other reasons.

The use of bottle holding devices is known in the prior art. While these devices fulfill their respective, particular objective and requirements, the aforementioned devices do not disclose a device that can hold a variety items in a health club or gym setting, and which device is easy to transport from one exercise station to another.

Therefore an accessory that overcomes the above described and other disadvantages is needed.

SUMMARY

The disclosed invention relates to a health club accessory comprising: a front semicylindrical wall, with a top surface; a rear wall attached to the front semicylindrical wall; a bottom wall attached to the front semicylindrical wall and rear wall, the front semicylindrical, rear wall, and bottom wall defining a semicylindrical volume; a handle member attached to the bottom wall, and extending out from semicylindrical front wall by a distance D, the handle member comprising: an underside; a downward extending handle, an upwardly extending guide 46 extending from the handle; a towel surface located on the handle member between the upwardly extending guide and the semicylindrical front wall; a semicylindrical groove located on the underside of the handle member; an elongated holding member extending downwardly from the rear wall two orthogonal members located at a distal end of the holding member, the two orthogonal members being generally at right angles to the elongated holding member, a space located between the two orthogonal members; a taper on the rear wall with an angle θ, which creates a fulcrum point on the rear wall; and a magnet located flush on the rear wall.

BRIEF DESCRIPTION OF THE DRAWINGS

The present disclosure will be better understood by those skilled in the pertinent art by referencing the accompanying drawings, where like elements are numbered alike in the several figures, in which.

DETAILED DESCRIPTION

Figure 1:
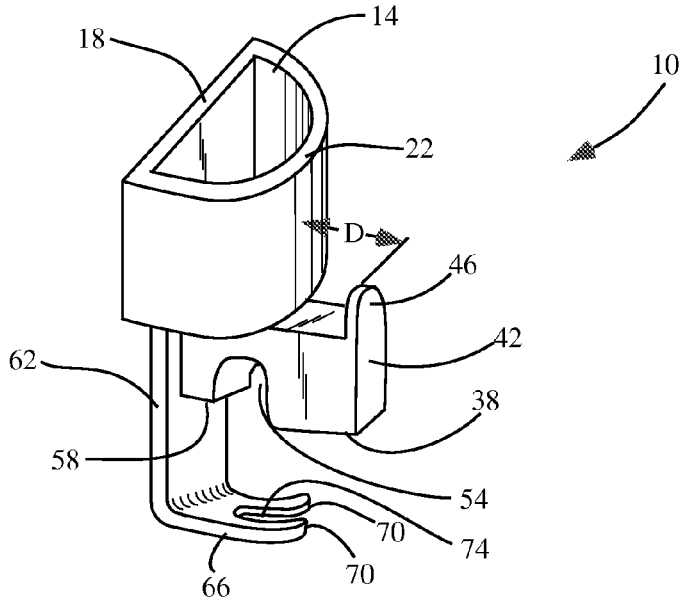
FIG. 1 is perspective view of the disclosed health club accessory.
Figure 2:
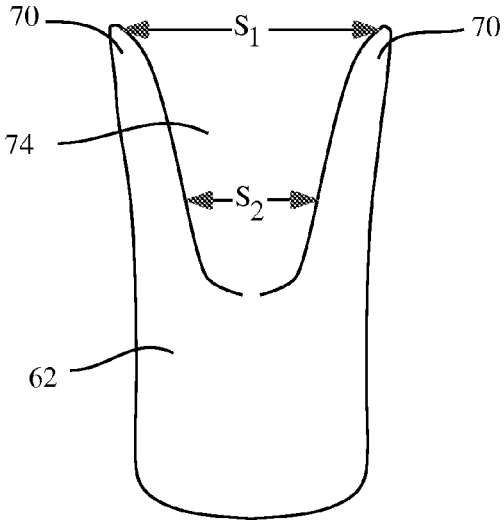
FIG. 2 is a top view of the two orthogonal members from the health club accessory.
Figure 3:
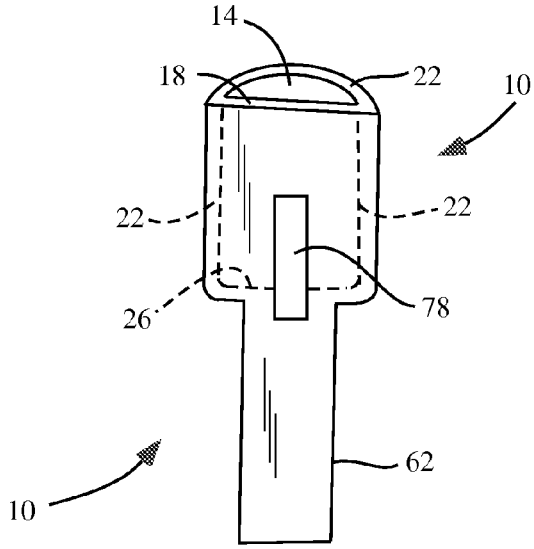
FIG. 3 is a back view of the disclosed health club accessory.

FIG. 1 is a perspective view of the disclosed health club accessory 10. The disclosed health club accessory 10 comprises a semicylindrical holding volume 14. The semicylindrical holding volume is defined by a rear wall 18, a semicylindrical front wall 22, and a bottom wall 26 (not visible in this view, but visible in FIG. 2). Attached to the bottom wall 26 is a handle member 38. The handle member 38 extends out from the semicylindrical front wall 22 by a distance "D". D is about ¾" to about 3", and preferable between about 1¼" to about 1½". The handle member 38 comprises a downward extending handle 42, and an upwardly extending guide 46. Located on the handle member 38, between the upwardly extending guide 46 and the semicylindrical front wall 22 is a towel surface 50. The handle member 38 is configured to hold a towel between the upwardly extending guide 46 and the semicylindrical front wall 22. A towel can be placed on the towel surface 50 and held in place between the extending guide 46 and the semicylindrical front wall 22. The handle member 38 also has a semicylindrical groove 54 located on the underside 58 of the handle member 38. This groove 54 is configured to allow the disclosed health club accessory 10 to hang from non-metallic and metallic equipment, such as, but not limited to mostly plastic treadmills, elliptical trainers, stationary bicycles, bicycles, coat racks, etc. Extending from the rear wall is an elongated holding member 62. At a distal end 66 of the holding member, are two orthogonal members 70. The orthogonal members 70 are generally at right angles to the holding member 62. There is a space 74 between the two orthogonal members 70. The two orthogonal members 70 are spaced apart such that they are able to hold a fluid containing bottle at the neck of the fluid containing bottle. FIG. 2 is a top view of the two orthogonal members 70. In this view, it can be seen that the distance "S" between the two orthogonal members 70 decreases from $S_1$ to $S_2$. $S_1$ is about 1" to about 2", and preferable about 1.5", and $S_2$ is about 0.5" to about 1.5", and preferable about 1". $S_1$ is located near the distal ends of the two orthogonal members 70, and $S_2$ is located near the proximal ends of the orthogonal members 70. The distance between the two orthogonal members 70 decreases from $S_1$ to $S_2$ in order to allow the elongated holding member 62 to be able to hold different size bottles and containers. FIG. 3 is a rear view of the disclosed health club accessory. In this view, the semicylindrical front wall 22, and bottom wall 26, are shown through the rear wall 18, and is indicated by dashed lines. A magnet 78 is located on the rear wall 18, flush against the rear wall 18. The magnet is configured to be powerful enough to hold the disclosed health club accessory against a metal surface while the disclosed health club accessory is holding a towel, a full water bottle, a cell phone, a set of keys, an and an Ipod. The magnet may be any suitable magnet, including but not limited to high grade Neodymium Iron Boron (NdFeB) magnets which may be nickel or gold plated, and may be grade N40 or higher. One particular magnetic that may be used, but this disclosure is not limited to, is a model number P125DH~½"×1"×⅛" from AMAZING MAGNETS, 3943 IRVINE BLVD #92, IRVINE, CA 92602. The magnet 78 is shown in generally a longitudinal orientation with respect to the elongated holding member 62. However, the magnet 78 may be placed in other locations on the rear wall and/or elongated holding member 62, and in different orientations. The handle 42 is configured to comfortably fit in a user's hand. The handle 62 can be grasped when the user desires to remove the disclosed health club accessory 10 from its magnetic attachment to a metal surface. The magnet 78 should be strong enough to hold up about 5 pounds to about 20 lbs of downward force, and preferably about 10 pounds of downward force.

Figure 4:
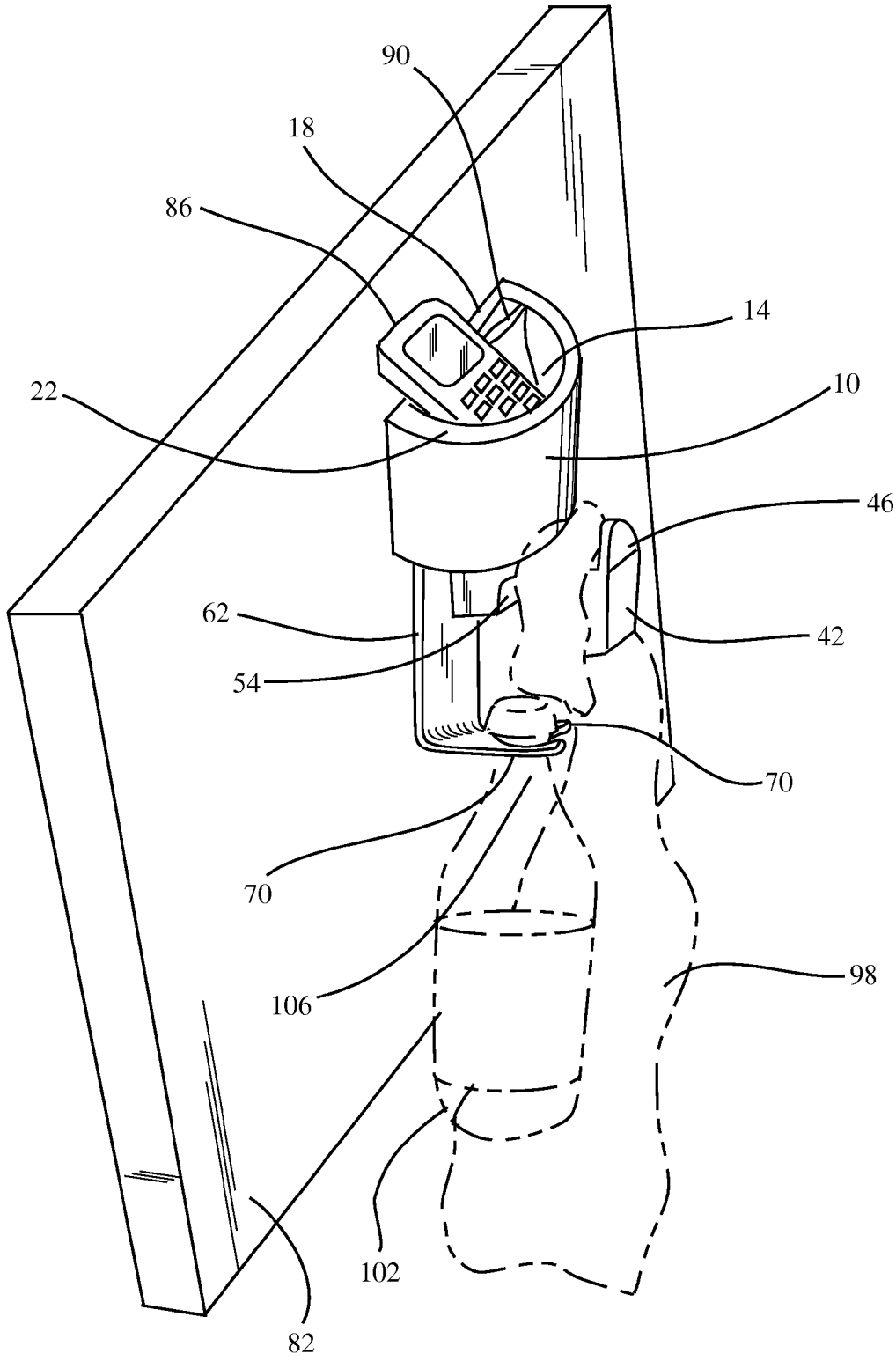
FIG. 4 is a perspective view of the disclosed health club accessory in use.

FIG. 4 shows the disclosed health club accessory 10, magnetically attached to a metal surface 82. Inside the semicylindrical holding volume 14 is an electronic device 86, such as, but not limited to a cell phone, ipod, walkman. Also in the semicylindrical holding volume 14 is a wallet 90. A towel 98 is shown hanging from the towel surface 50 (not visible due to the towel) between the upwardly extending guide 46 and the semicylindrical front wall 22. A water bottle 102 is shown hanging from its neck 106 between the two orthogonal members 70. In other configurations, rather than magnetically attaching the disclosed health club accessory 10 to a metal surface, the disclosed health club accessory 10 can be hung from a bar, tube, rod, etc. via its groove 54.

Figure 5:
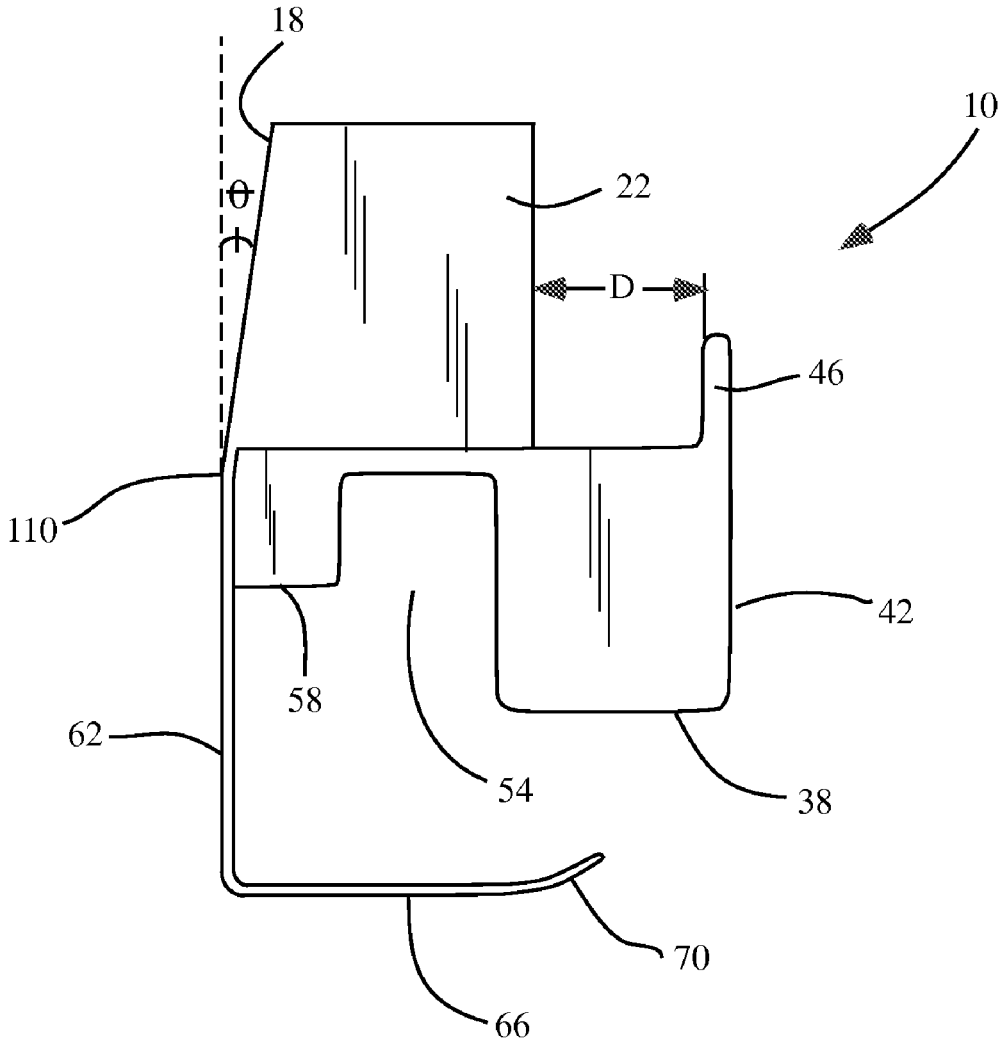
FIG. 5 is a side view of the disclosed health club accessory.

FIG. 5 shows a side view of the disclosed health club accessory 10. In this view a taper is shown on the rear wall 18. The taper of the rear wall has an angle θ. The angle θ may be between about 2° and 10°, and preferable about 4°. This taper allows a point 110 on the rear wall to act as a fulcrum when a user grabs the handle 42, and rocks the handle back and forth in order to remove the magnetic 78 from its attachment to a magnetic surface.

The disclosed device 10 may be made generally out of any suitable material, including, but not limited to plastic, fiberglass, metal, and wood.

The advantages of the disclosed health club accessory are it allows a user to carry around his or her towel, cell-phone, wallet, keys, and water bottle, and thereafter magnetically attach the disclosed health accessory to a metal surface, or hang the disclosed health club accessory on a piece of equipment via the groove. Such a device provides a convenient means to store the user's belonging up off the floor, and in view of the user, so that the user is less likely to forget his belongings.

It should be noted that the terms "first", "second", and "third", and the like may be used herein to modify elements performing similar and/or analogous functions. These modifiers do not imply a spatial, sequential, or hierarchical order to the modified elements unless specifically stated.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiments disclosed as the best mode contemplated for carrying out this disclosure, but that the disclosure will include all embodiments falling within the scope of the appended claims.

What is claimed is:

1. A health club accessory comprising:

a front semicylindrical wall, with a top surface;

a rear wall attached to the front semicylindrical wall;

a bottom wall attached to the front semicylindrical wall and rear wall, the front semicylindrical wall, the rear wall, and the bottom wall defining a semicylindrical volume;

a handle member attached to the bottom wall, and extending out from semicylindrical front wall by a distance D, the handle member comprising:

an underside;

a downward extending handle, an upwardly extending guide extending from the handle;

a towel surface located on the handle member between the upwardly extending guide and the semicylindrical front wall;

a semicylindrical groove located on the underside of the handle member;

an elongated holding member extending downwardly from the rear wall two orthogonal members located at a distal end of the holding member, the two orthogonal members being generally at right angles to the elongated holding member;

a space located between the two orthogonal members;

a taper on the rear wall with an angle θ, which creates a fulcrum point on the rear wall; and a magnet located flush on the rear wall.

2. The health club accessory of claim 1, wherein the length of the space between the two orthogonal members decreases from a maximum distance of $S_1$ between the distal ends of the two orthogonal members to a minimum distance of $S_2$ between the proximal ends of the two orthogonal members.

3. The health club accessory of claim 1, wherein the angle θ is between about 2° and 10°.

4. The health club accessory of claim 1, wherein the angle θ is about 4°.

5. The health club accessory of claim 1, wherein the distance D is between about ¾" to about 3".

6. The health club accessory of claim 1, wherein the distance D is between about 1¼" to about 1½".

7. The health club accessory of claim 1, wherein the health club accessory is generally manufactured from one of the materials selected from the group consisting of metal, plastic, wood, and fiberglass.

8. The health club of accessory of claim 1, wherein the health club accessory is able to be hung by the groove.

9. The health club of accessory of claim 1, wherein the magnet is strong enough to hold the weight of the health club accessory against a metal surface plus an additional 10 pounds.

* * * * *